US012179886B2

(12) United States Patent
Frodé

(10) Patent No.: US 12,179,886 B2
(45) Date of Patent: Dec. 31, 2024

(54) BOARDING POLE PROTECTION

(71) Applicant: FRODÉ MARINA AB, Vaxholm (SE)

(72) Inventor: Mikael Frodé, Vaxholm (SE)

(73) Assignee: FRODE MARINA AB, Vaxholm (SE)

( * ) Notice: Subject to any disclaimer, the term of this patent is extended or adjusted under 35 U.S.C. 154(b) by 72 days.

(21) Appl. No.: 17/272,228

(22) PCT Filed: Sep. 16, 2019

(86) PCT No.: PCT/EP2019/074636
§ 371 (c)(1),
(2) Date: Mar. 12, 2021

(87) PCT Pub. No.: WO2020/058158
PCT Pub. Date: Mar. 26, 2020

(65) Prior Publication Data

US 2021/0179232 A1 Jun. 17, 2021

(30) Foreign Application Priority Data

Sep. 19, 2018 (SE) ..... 1851110-5

(51) Int. Cl.
*B63B 21/54* (2006.01)

(52) U.S. Cl.
CPC ..... *B63B 21/54* (2013.01)

(58) Field of Classification Search
CPC ..... B63B 21/54; B63B 7/082; B63B 7/085; B63B 27/14; B63B 2027/141; B63B 27/143; B63B 27/146; B63B 27/19; B63G 13/00
See application file for complete search history.

(56) References Cited

U.S. PATENT DOCUMENTS 5,123,372 A * 6/1992 Kobayashi ..... B63B 27/14 114/362
2018/0085820 A1 3/2018 Otto
2020/0180010 A1 6/2020 Ivarson et al.

FOREIGN PATENT DOCUMENTS

CN 203666933 U 6/2014
DE 2738128 A1 3/1979
KR 20130019368 A 2/2013
KR 101315292 B1 10/2013

OTHER PUBLICATIONS

International Search Report Issued in International Patent Application No. PCT/EP2019/076037 on Jan. 10, 2020, 5 pages.
International Preliminary Report on Patentability issued in the International Patent Application No. PCT/EP2019/074636 on Dec. 4, 2020, 5 Pages.

* cited by examiner

*Primary Examiner* — Andrew Polay
(74) *Attorney, Agent, or Firm* — Schott, P.C.

(57) ABSTRACT

A marine surface vessel includes a boarding pole for maritime boarding actions and the boarding pole is at a first end of the boarding pole, attached to a deck of the vessel via a flexible joint. The vessel includes a holding device presenting, or being arranged to present, a holding cavity arranged to receive, in a non-erected condition of the boarding pole, a boarding engagement device at a second end of the boarding pole, which second end is opposite to the first end.

13 Claims, 9 Drawing Sheets

BOARDING POLE PROTECTION

TECHNICAL FIELD

The invention relates to a marine surface vessel comprising a boarding pole for maritime boarding actions, wherein the boarding pole is, at a first end of the boarding pole, attached to a deck of the vessel via a flexible joint.

BACKGROUND

Boarding poles are used in so called Visit, Board, Search, and Seizure (VBSS) marine actions. VBSS teams are trained to capture enemy vessels, to combat terrorism, piracy, and smuggling, and to conduct customs, safety, and other inspections. A boarding pole may form a hook and climb VBSS boarding system. An example of a boarding pole is produced by SOSSAB, distributed by H. Henriksen A S and marketed as the REBS Giraffe Tracer Pneumatic Telescopic Pole. A boarding pole is typically fitted in a marine vessel, such as a rigid-inflatable boat (RIB). The boarding pole is connected to the vessel deck via a flexible joint. The vessel may be maneuvered so as to be next to another vessel, e.g. a ship, to be boarded. A person may erect the boarding pole so as to be substantially vertical. The pole has a hook at the upper, distal end thereof. A rope ladder is suspended from the hook. The telescopic pole may thereafter be extended, by means of pressurized air. Thereafter, the pole may be swung so as for the hook to engage a gunwale of the other vessel. Thereby, the rope ladder is made to hang from the gunwale of the other vessel, down to the boarding vessel. Thereafter, the hook and the rope ladder are released from the rest of the pole by means of a release mechanism, which may be controllable by pressurized air. Thereafter, one or more persons may board the other vessel, using the rope ladder.

When a vessel, equipped with a boarding pole, is in an operational state where the boarding pole is not used, for example during transport towards the vessel to be boarded, the boarding pole is usually not erected. The pole may thereby be in the way of other activities on the vessel. Also, the hook of the boarding pole, usually provided with a hard metal tip, may present a safety hazard to persons on the vessel. This problem may be particularly large during high seas, at which it may be difficult to keep the balance on board the vessel equipped with the boarding pole.

SUMMARY

An object of the invention is to facilitate maritime boarding actions by use of boarding poles. It is a further object to increase safety of persons on board a marine surface vessel comprising a boarding pole for maritime boarding actions.

The objects are achieved by a marine surface vessel according to claim 1. Thus, the objects are achieved by a marine surface vessel comprising a boarding pole for maritime boarding actions, wherein the boarding pole is, at a first end of the boarding pole, attached to a deck of the vessel via a flexible joint, wherein the vessel comprises a holding device presenting, or being arranged to present, a holding cavity arranged to receive, in a non-erected condition of the boarding pole, a boarding engagement device at a second end of the boarding pole, which second end is opposite to the first end.

The holding device may be a holding structure. Thereby, the holding device may be solid, or partly solid. For example, the holding device may be made, at least partly, from panels. The panels may form walls. As a further example, the holding device may be made, at least partly, from rods. The holding device may permanently present the holding cavity. As exemplified below, in some embodiments, the holding device is flexible, or partly flexible. Thereby, the holding device may be arranged to present the holding cavity.

The vessel may comprise an attachment device, the attachment device being connected to the flexible joint. The attachment device may be provided at a deck of the vessel. The attachment device may be provided in a deck of the vessel. The attachment device may be provided in the deck by being mounted directly to the deck, or by being mounted to the deck via a device, such as a rail. The boarding pole may be attached to the attachment device via the flexible joint. The boarding pole may be arranged to be erected so as to extend from the attachment device, to a further vessel to be boarded. The boarding pole may, at the second end of the boarding pole, which second end is opposite to the first end, be provided with the boarding engagement device, for engaging a part of a vessel to be boarded. The engagement device may be provided in the form of a hook.

The holding device, provided as a holding structure or an at least partly flexible holding device, provides protection from the engagement device while the boarding pole is not in use. More specifically, the holding cavity being arranged to receive the engagement device, allows for the engagement device to be stowed away in the holding cavity. Thereby, person on the vessel may be protected from the engagement device. When the boarding pole is to be used, the boarding pole may be erected by rotating the boarding pole around the attachment device, so at to remove engagement device from holding device.

The holding device, provided as a holding structure or an at least partly flexible holding device, may be arranged to fix the engagement device. The holding cavity may form a pocket for the engagement device to be held. The holding device may also be arranged to stow away a release mechanism, arranged to separate the engagement device from the remainder of the boarding pole. The holding device may be arranged to fix the release mechanism.

In the holding device, provided as a holding structure or an at least partly flexible holding device, the engagement device may be connected to the remainder of the boarding pole. Thereby, the boarding pole may be ready to use. Such use may be fast and controlled. Thus, as well as reducing the risk of injuries to persons onboard, the risk of lost time is reduced.

Preferably, the holding device, provided as a holding structure or an at least partly flexible holding device, is arranged to surround the engagement device on at least three sides of the engagement device. Thereby, a firm fixing of the engagement device may be secured in the non-erected condition of the boarding pole.

Preferably, the holding device, provided as a holding structure or an at least partly flexible holding device, is arranged to extend, in relation to the vessel, below the boarding engagement device, and on both lateral sides of the boarding engagement device. Thereby, the holding device is arranged to surround the engagement device below, and on both sides, laterally in relation to the vessel. Thereby, the engagement device may be supported both vertically and laterally.

Preferably, the holding cavity has a larger extension vertically and longitudinally, than laterally, in relation to the vessel. Thereby, the holding device, provided as a holding structure or an at least partly flexible holding device, may be adapted to receive the engagement device where the engagement device is in the form of a hook. Herein, longitudinally means oriented in a direction of straight travel of the vessel.

Preferably, the holding device, provided as a holding structure or an at least partly flexible holding device, comprises a cover. The cover may be removable from the rest of the holding structure. In some embodiments, the cover may be hinged to the rest of the holding device. The cover may provide an increased protection from the engagement device while the boarding pole is not in use. The boarding pole may be erected by removing the cover, and rotating boarding pole around the attachment device, so at to remove the engagement device from holding device. When the boarding pole is not in use, the cover may provide a support surface for persons onboard. Thereby, the engagement device is covered, and persons onboard are protected from it.

In some embodiments, the cover may be provided in the form of a lid, arranged to cover the holding cavity. In some embodiments, the cover may be adapted to surround the engagement device. The cover may be a removable housing. Thereby, the cover may form at least a part of the holding cavity.

Preferably, the holding device, provided as a holding structure or an at least partly flexible holding device, presents a storage cavity arranged to receive a flexible climbing means, e.g. a rope ladder, which is attached to the engagement device. Thereby the flexible climbing means may be stored while connected to the engagement device. Thereby, the flexible climbing means is protected while not in use, and ready to follow the engagement device when the boarding pole is erected.

Preferably, the boarding pole is substantially parallel with a longitudinal direction of the vessel while the engagement device is received in the holding cavity. Thereby, the boarding pole may be substantially parallel with a deck of the vessel. This allows for reducing the interference of the boarding pole, while not in use, with persons or other equipment on the vessel.

Preferably, the holding device, provided as a holding structure or an at least partly flexible holding device, is, in the vessel, located forward of the flexible joint. Thereby, the vessel may comprise an attachment device at a deck of the vessel. The vessel may comprise an attachment device in a deck of the vessel. The attachment device may be adapted to be connected to the flexible joint. Thus, the holding device may be, in the vessel, located forward of the attachment device. However, alternatively, the holding device may be, in the vessel, located aft of the flexible joint. Thereby, the holding device may be, in the vessel, located aft of the attachment device.

In some embodiments, as exemplified below, a plurality of attachment device may be provided. Thereby, a plurality of holding devices, provided as one or more holding structures and/or one or more at least partly flexible holding devices, may be provided. Each holding device may be used for mounting the boarding pole at a respective of the attachment devices.

As mentioned, in some embodiments, the holding device is flexible, or partly flexible. Thereby, the holding device may be arranged to present the holding cavity. In some embodiments, the flexibility may allow the holding device to be collapsed, e.g. by being flattened or folded. Thereby, the holding cavity may be selectively presented by the holding device, e.g. when the holding cavity receives the boarding engagement device. The holding device may be made, at least partly, by fabric. The holding device may be formed as a pocket, e.g. in the form of a bag. The at least partly flexible holding device may be mounted to a gunwale of the vessel.

The objects are also reached with a marine surface vessel arranged to carry a boarding pole for maritime boarding actions, the vessel comprises an attachment device at a deck of the vessel, the attachment device being adapted to be connected to a flexible joint provided at a first end of the boarding pole, wherein the vessel comprises a holding device presenting, or being arranged to present, a holding cavity arranged to receive an engagement device at a second end of the boarding pole, which second end is opposite to the first end. The vessel may comprise an attachment device in the deck of the vessel.

An aspect of the invention provides a marine surface vessel arranged to carry a boarding pole for maritime boarding actions, wherein the vessel comprises a plurality of attachment devices at a deck of the vessel. The vessel may comprise a plurality of attachment devices in the deck of the vessel. Each of the attachment devices is adapted to be connected to a flexible joint provided at a first end of the boarding pole. Thereby, the boarding pole may be erected selectively at one of a plurality of locations on the vessel. This provides flexibility to adapt to the operational situation.

Preferably, the vessel comprises a plurality of air supply connections for the boarding pole, each air supply connection being provided in relation to a respective of the attachment devices, so that the boarding pole may be connected to the respective air supply connection, while the boarding pole is connected to the respective attachment device. Each air supply connection may be provided in a vicinity of a respective of the attachment devices. Such embodiments are advantageous where the boarding pole is telescopic, and arranged to extend by means of pressurized air. The boarding pole may further comprise a conduit for the provision of the pressurized air, from a pressurized air source. By a plurality of air supply connections, each provided in a vicinity of a respective of the attachment devices, the supply of pressurized air is facilitated, when the boarding pole is moved to a selected attachment device.

A vessel with a plurality of attachment devices at a deck of the vessel, may be provided with one or more holding devices, each arranged to receive the engagement device, as described above.

The attachment devices may be in the deck of the vessel. Thereby, the attachment devices may be mounted to the deck directly, or via a device, such as a rail. One, more, or all, of the attachment devices may be mounted on a respective rail, so that the position of the respective attachment device along the rail may be adjusted. Thus, the respective attachment device may be provided in the deck of the vessel, by being mounted to a rail. The rail may in turn be mounted to the deck. The rail may extend in any suitable direction of the vessel, e.g. in a longitudinal direction of the vessel, or in a lateral direction of the vessel.

An aspect of the invention provides a marine surface vessel arranged to carry a boarding pole for maritime boarding actions, wherein the vessel comprises an attachment device at a deck of the vessel. The vessel may comprise an attachment device in the deck of the vessel. The attachment device is adapted to be connected to a flexible joint provided at a first end of the boarding pole. The attachment device is mounted to the deck so as to be movable, and fixable at any of a plurality of locations distributed in two dimensions along at least a portion of the deck.

The attachment device may be mounted on a first rail, and arranged to be moved along the first rail, and fixed to the first rail at any of a plurality of locations along the first rail. The first rail may be mounted on one or more second rails, oriented at a non-zero angle, for example perpendicular, to the first rail. The one or more second rails may be mounted to the deck of the vessel. The first rail may be arranged to be moved along the one or more second rails, and fixed to the one or more second rails at any of a respective plurality of locations along the one or more second rails.

Thereby, the attachment device may be positioned at a plurality of locations in two dimensions along the deck. This is advantageous since it allows a flexible adjustment of the attachment device position in two dimensions. The most advantageous position for the boarding pole may be different depending on the type of boarding action to be performed. For example, the most advantageous boarding pole position when boarding a moving ship, may be different from the most advantageous boarding pole position when boarding a ship which is docked.

A further aspect of the invention provides a storage compartment for at least one elongated gas cylinder, for example a diving bottle, for pressurized air for a boarding pole for maritime boarding actions. The storage compartment may be fitted, or arranged to be fitted, in a marine surface vessel arranged to carry the boarding pole. Hence the further aspect of the invention may provide a marine surface vessel arranged to carry a boarding pole for maritime boarding actions, wherein the vessel comprises a storage compartment for at least one elongated gas cylinder, for example a diving bottle, for pressurized air for the boarding pole. The gas cylinder may be connectable to one or more air conduits, connected to one or more air supply connections for the boarding pole. The storage compartment may be arranged to store the gas cylinder substantially vertically. The storage compartment may comprise a seat for the gas cylinder, arranged so as for the gas cylinder to rest with a lower end of the gas cylinder in the seat. Thereby, the seat may have a complementary shape, e.g. of a partly spherical concavity. The storage compartment may further comprise a hatch, arranged to open outwards. The hatch may be hinged along a lower edge thereof. The storage compartment may further comprise a fastening arrangement arranged to secure, above the seat, the gas cylinder to the hatch.

Thereby, when the hatch is opened, the gas cylinder follows the hatch, and is tilted outwards, e.g. 10-30 degrees. Where the storage compartment is arranged to store the gas cylinder substantially vertically, when the hatch is opened, the gas cylinder may be tilted outwards, e.g. 10-30 degrees, while gas cylinder still rests in the seat. Subsequently, the fastening arrangement may be loosened, and the gas cylinder may be easily removed, to be exchanged.

The storage compartment may be provided in a vessel according to any embodiment described or claimed herein.

Further advantages and advantageous features of the invention are disclosed in the following description and in the dependent claims.

BRIEF DESCRIPTION OF THE DRAWINGS

Below, embodiments of the invention will be described with reference to the drawings, in which.

DETAILED DESCRIPTION OF EMBODIMENTS OF THE INVENTION

Figure 1:
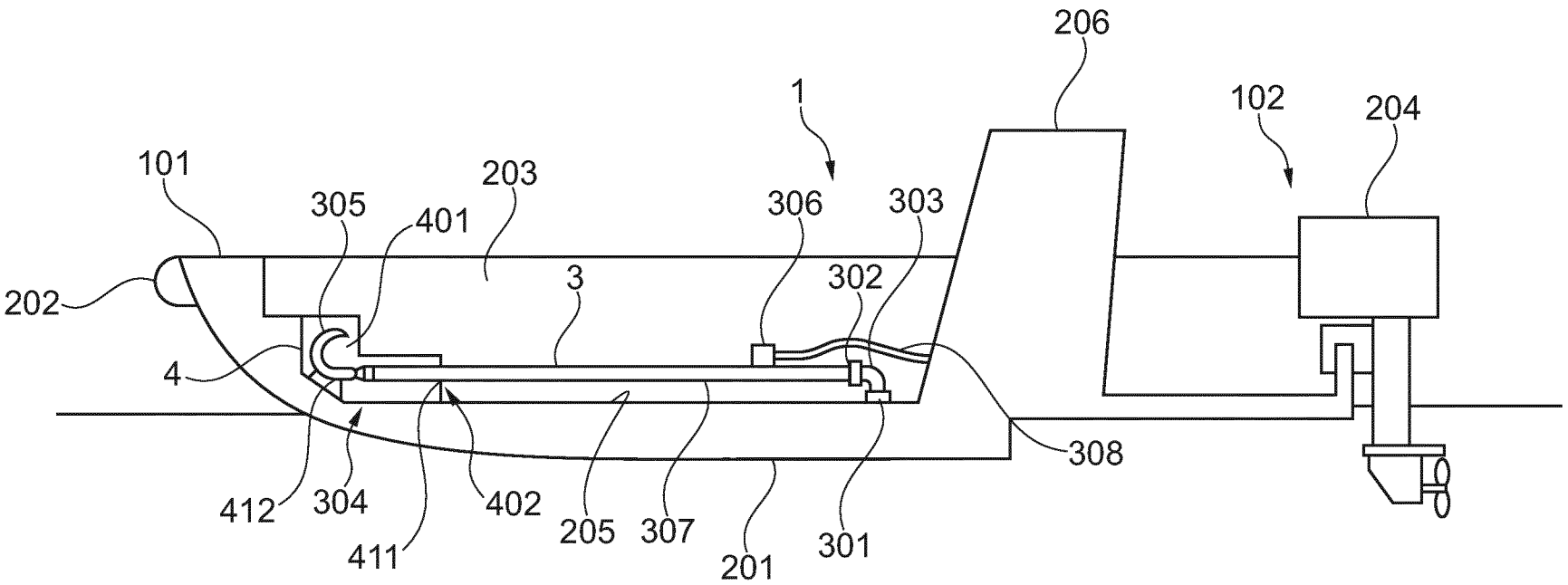
FIG. 1 shows a vertical cross-section of a vessel according to an embodiment of the invention, the cross-section being oriented in the longitudinal direction of the vessel.

FIG. 1 shows a longitudinal, vertical section of a marine surface vessel in the form of a rigid-inflatable boat (RIB). The boat in FIG. 1 comprises a solid, shaped hull 201 and flexible tubes 202 at a gunwale 203. The hull 201 may be made in any suitable material, such as steel, wood, aluminium, or fibre-reinforced plastic, such as glass-reinforced plastic (GRP) composite, or carbon reinforced plastic. The hull may present a single skin, or it can be a sandwich construction. The hull 201 may be a "deep-V hull", or a "shallow-V" hull, a catamaran hull, or a trimaran hull.

In the example shown in FIG. 1, the solid hull 201 reaches to the top of the tubes 202. Thereby, the solid hull 201 forms an internal part of the gunwale 203. Hence, only a forward end of the tubes 202 are visible in the cross-section of FIG. 1. The tubes 202 may be provided outside of the solid hull, along the sides thereof. The tubes 202 may be joined at the bow 101. At the stern 102, an outboard engine mounting board is provided, with one or more outboard engines 204.

It should be noted that the invention is equally applicable to alternative types of vessels. For example, the vessel may have a fully rigid hull. The vessel may have one or more inboard engines.

The vessel further presents a deck 205. The deck is surrounded by the gunwale 203. The vessel further comprises a steering console 206. The steering console presents control devices for a driver of the vessel, such as a steering wheel, engine control devices, and instruments. The console 206 may further house equipment for the vessel, or for a mission of the vessel.

The vessel 1 comprises a boarding pole 3 for maritime boarding actions. An attachment device 301 is provided in the deck 205. The attachment device may be mounted to the deck directly, or via a device, such as a rail. The attachment device is located in front of the console 206. The boarding pole 3 is, at a first end 302 of the boarding pole, attached to the attachment device 301 via a flexible joint 303. The flexible joint 303 may be provided in any suitable form, e.g. as a rubber pin, or a helical spring. The attachment device may be provided in any suitable form, e.g. as a female adaptor, arranged to receive a male adaptor at an end of the flexible joint 303.

At a second end 304 of the boarding pole 3, which is opposite to the first end 302, the boarding pole 3 is provided with a boarding engagement device 305. The boarding engagement device is provided in the form of a hook. The hook has a tip made of hard metal, such as hardened steel, or a tungsten carbide. It should be noted that the boarding engagement device may be provided in any alternative suitable form, for engaging a part of a vessel to be boarded.

Between the flexible joint 303 and the boarding engagement device 305, the boarding pole 3 presents an elongated portion 307. In FIG. 1, the boarding pole 3 is substantially parallel with a longitudinal direction of the vessel. Herein, the vessel longitudinal direction is understood as a direction of straight travel of the vessel. By means of the flexible joint 303, the boarding pole 3 may be erected by a person, while attached to the attachment device 301. At the second end 304, a flexible climbing means in the form of a rope ladder, not shown in FIG. 1, is connected to the engagement device, so as to hang from the second end when the boarding pole 3 is erected.

The boarding pole 3 may be telescopic. For example, the elongated portion 307 may be telescopic. The boarding pole 3 may comprise a maneuvering device 306. The boarding pole 3 may further comprise a conduit 308 for the provision of pressurized air, from a pressurized air source (not shown in FIG. 1). The pressurized air may be, by control of the maneuvering device 306, allowed to enter the boarding pole 3, for extending the boarding pole 3 in a telescopic manner. For example, the pressurized air may be allowed to enter the elongated portion 307. It should be noted that other manners of extending the pole are conceivable.

It should be noted that the extension of the boarding pole 3 may be driven in any suitable manner, e.g. hydraulically, pneumatically, electrically, or manually. Embodiments of the invention may allow raising the boarding pole 3, followed by extending it.

The boarding engagement device 305 is arranged to be released, by control of the maneuvering device 306, from the elongated portion 307.

Thus, a person driving the vessel 1, here the boarding vessel, may manoeuvre the vessel so as to be next to another vessel, e.g. a ship, to be boarded. Another person, here referred to as a pole control person, may erect the boarding pole 3 so as to be non-horizontal, e.g. substantially vertical. The pole control person may thereafter allow, by control of the maneuvering device 306, the extension of the boarding pole 3. Thereafter, the pole control person may swing the pole so as for the engagement device 305 to engage a gunwale of the other vessel. Thereby, the rope ladder is made to hang from the gunwale of the other vessel, down to the boarding vessel 1. Thereafter, the pole control person may release the engagement device 305 from the elongated portion 307. Thereafter, one or more persons may board the other vessel, using the rope ladder.

The vessel 1 comprises a holding device 4. The holding device is provided in the form of a holding structure 4. The holding device 4 is, in the vessel, located forward of the attachment device 301. The holding device 4 is located close to the bow 101 of the vessel.

The holding device 4 presents a holding cavity 401. The holding cavity 401 is arranged to receive, in a non-erected condition of the boarding pole, the boarding engagement device 305. The holding device presents an opening 402, through which the boarding pole 3 extends from the holding cavity 401. Thereby, a major part of the elongated portion 307 is exposed, outside of the holding cavity 401. Thus, the boarding pole 3 may be arranged with the engagement device 305 in the holding cavity 401, while the boarding pole is attached to the attachment device 301 via the flexible joint 303. Thereby, the boarding pole 3 is substantially parallel with the deck 205 while the engagement device 305 is received in the holding cavity 401.

Figure 2:
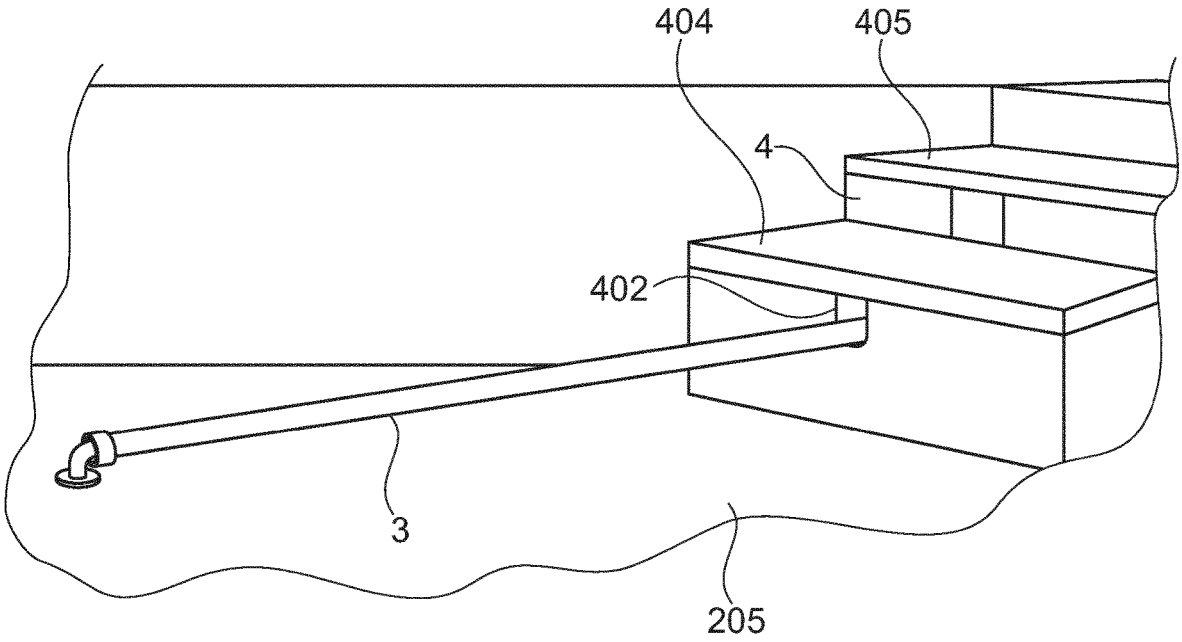
FIG. 2 and FIG. 3 show perspective views of a holding structure in the vessel in FIG. 1.

Reference is made to FIG. 2. The holding device 4 comprises two covers 404, 405. The covers are provided in the form of lids. The holding device is arranged to form, with the covers 404, 405 two levels of external support surfaces, when the covers rest on the rest of the holding device 4.

Figure 3:
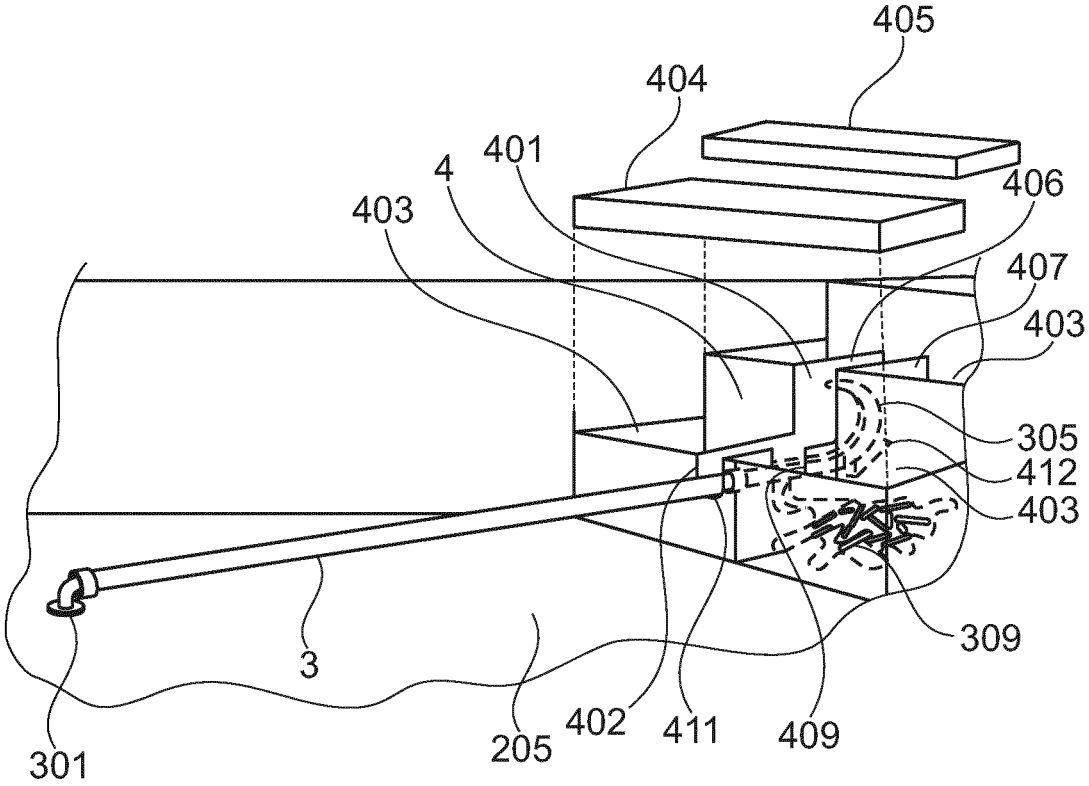

Reference is made to FIG. 3, showing the holding device with the covers 404, 405 lifted from the rest of the holding device. The holding cavity 401 is arranged centrally in the holding device 4. The opening 402, through which the boarding pole 3 extends from the holding cavity 401, is provided as a recess in one of the walls in the holding device 4.

The boarding pole 3 may rest on the recess 402. More generally, the holding device may provide a vertical support 411 for the boarding pole 3. The holding device may be arranged to provide a vertical support 411, e.g. by means of the recess 402, for the elongated portion 307 of the boarding pole 3. Alternatively, or in addition, the holding device may be arranged to provide a vertical support 412 of the engagement device 305. An engagement device support device 412 may be provided to support the engagement device 305. Supporting vertically the elongated portion 307 as well as the engagement device 305, prevents the engagement device 305 from breaking away from the elongated portion, e.g. by inertia caused by vessel motions.

The holding cavity 401 is delimited by two vertical, cavity walls 406, 407. The cavity walls work as support structures for the engagement device 305. Each of the cavity walls 406, 407 extend longitudinally and vertically in the vessel. The cavity walls 406, 407 are provided at a lateral distance from each other so as to provide a space between them, for the engagement device 305. The distance between the cavity walls 406, 407 is such that, when the engagement device 305 is oriented so as to extend majorly longitudinally and vertically in the vessel, it is laterally supported by the cavity walls 406, 407. Thereby, the holding cavity 401 has a larger extension vertically and longitudinally in the vessel, than laterally in the vessel.

Thus, the holding device 4 is arranged to surround the engagement device 305 on four sides of the engagement device. More specifically, in addition to laterally, by the cavity walls 406, 407, the engagement device 305 is surrounded below by an extension of the deck 205 below the engagement device 305, and above by the covers 404, 405, when the latter rest on the remainder of the holding device 4.

The holding device 4 presents in addition to the holding cavity 401 a plurality of storage cavities 403. One of the storage cavities 403 is arranged to receive flexible climbing means, in this example a rope ladder 309, which is attached to the engagement device 305. A recess 409 in the cavity wall 407 separating the holding cavity 401 from the storage cavity 403, arranged to receive the rope ladder 309, allows for an end portion of the rope ladder to extend from the storage cavity 403 to the engagement device 305.

It is understood that the holding cavity 401 provides for stowing away the engagement device 305 so as to provide a protection for staff against the engagement device, for example its hard metal tip, when not used. It is understood from FIG. 2 that the covers 404, 405 provide an increased protection from the engagement device 305 while the boarding pole 3 is not used.

The arrangement described provides an easily accessible boarding pole 3. For using the pole, the covers 404, 405 are removed, and the boarding pole 3 is erected by rotating the pole around the attachment device 301, so at to remove engagement device 305, and the rope ladder 309 attached to it, from the holding device.

Figure 4:
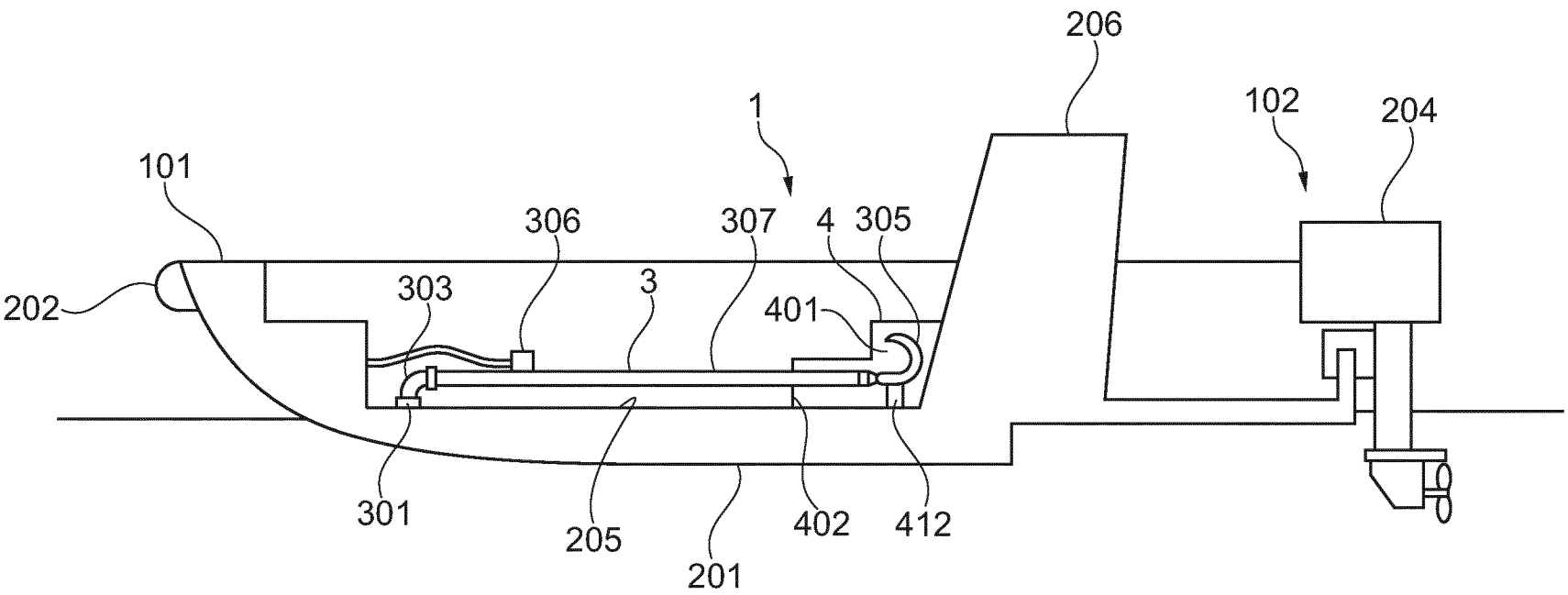
FIG. 4 shows a vertical cross-section of a vessel according to an alternative embodiment of the invention, the cross-section being oriented in the longitudinal direction of the vessel.

FIG. 4 shows an alternative embodiment of the invention. As in the embodiment described above, the vessel in this embodiment comprises a holding device 4. The holding device is in the form of a holding structure 4. The holding device 4 is, in the vessel 1, located aft of the attachment device 301. The holding device 4 is located forward of the console 206. The holding device 4 is located next to the console 206. The attachment device 301 is located toward the bow 101. The holding device may be arranged to provide a vertical support, e.g. by an elongated portion support device 411, for the elongated portion 307 of the boarding pole 3, as well as a vertical support, e.g. by an engagement device support device 412, of the engagement device 305.

Figure 5:
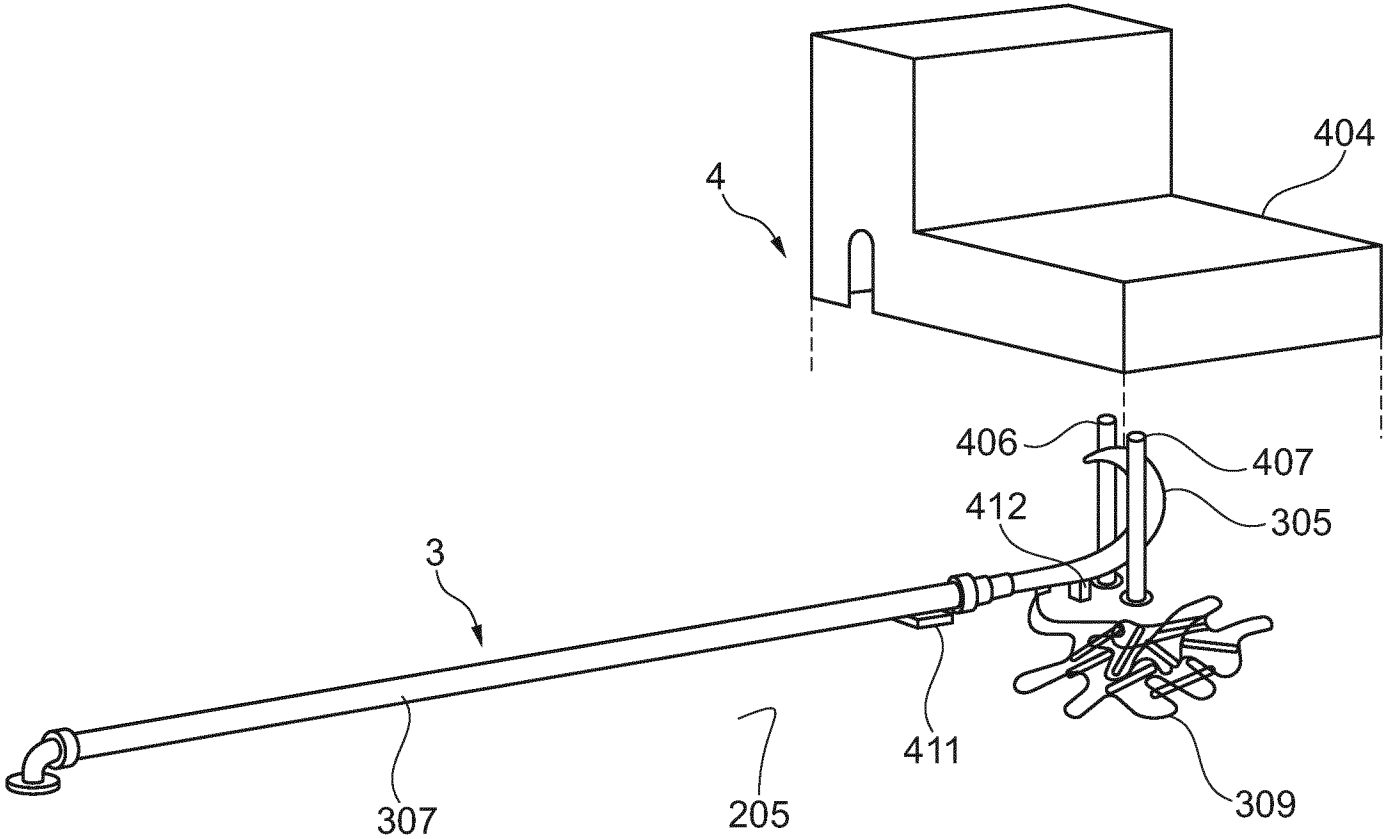
FIG. 5 shows a perspective view of a holding structure according to a further embodiment of the invention.

FIG. 5 shows a further embodiment of the invention. The holding device 4 comprises two support structures 406, 407, distributed on opposite lateral sides of the engagement device 305. In this example, the support structures 406, 407 are provided in the form of vertical rods, extending from the vessel deck 205. The distance between the support structures 406, 407 is such that, when the engagement device 305 is oriented so as to extend majorly longitudinally and vertically in the vessel, it is laterally supported by the support structures 406, 407.

The holding device may be arranged to provide a vertical support, e.g. by an elongated portion support device 411, for the elongated portion 307 of the boarding pole 3, as well as a vertical support, e.g. by an engagement device support device 412, of the engagement device 305.

The holding device 4 further comprises a cover 404. The cover is provided in the form of a housing. Thus, the cover 404 is arranged to surround the engagement device 305 on three sides of the engagement device. More specifically, the engagement device 305 is surrounded by the cover 404 laterally, and above, when the cover 404 rests on the vessel deck 205. Thus, in this embodiment, the cover 404 presents the holding cavity of the holding device.

The cover is also arranged to cover the flexible climbing means, in this example a rope ladder 309, which is attached to the engagement device 305. For this, the cover presents a storage cavity. The storage cavity is provided next to the holding cavity.

Figure 6:
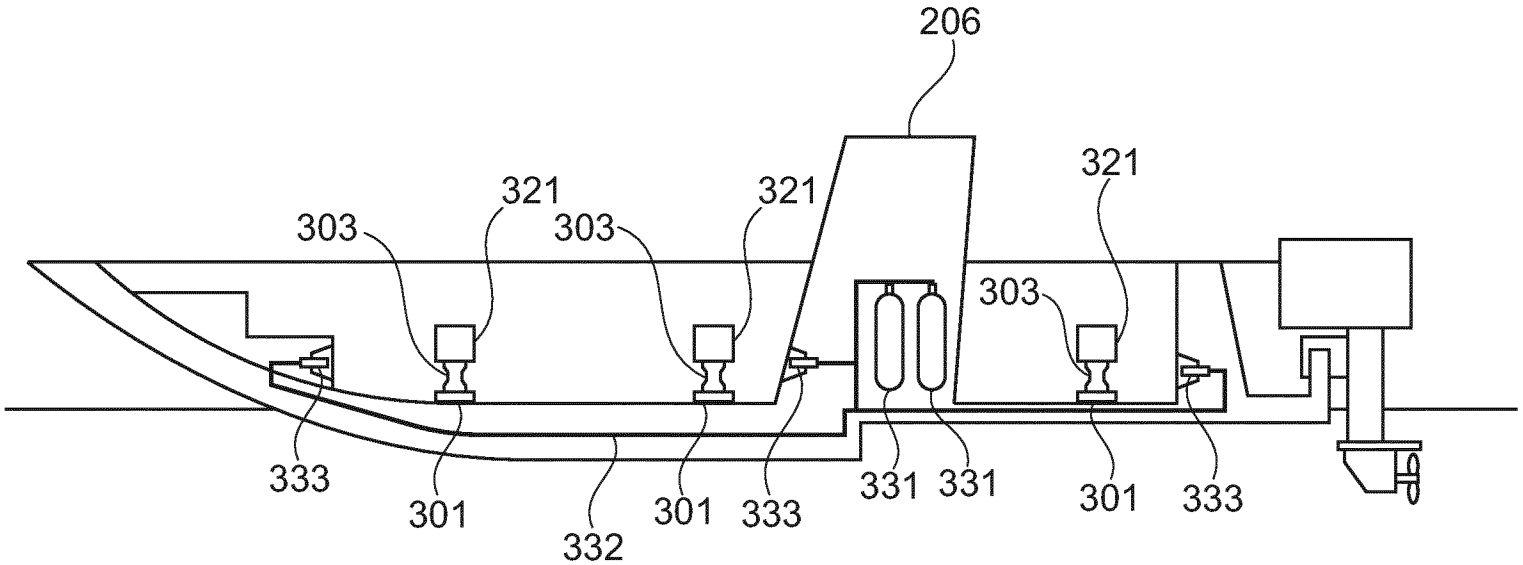
FIG. 6 shows a vertical cross-section of a vessel with an alternative aspect of the invention, the cross-section being oriented in the longitudinal direction of the vessel.

Reference is made to FIG. 6, showing a marine surface vessel adapted to carry a boarding pole (not shown in FIG. 6). The boarding pole is telescopic, and can be extended by the provision of pressurized air, from a pressurized air source.

The vessel in FIG. 6 is similar to the vessels described above with reference to FIG. 1-FIG. 5, and with the following additional features. The vessel comprises a plurality of, in this example three, attachment devices 301 in the deck 205 of the vessel. Each of the attachment devices 301 is connected to a flexible joint 303. Each flexible joint 303 is arranged to be connected, via a respective adaptor 321, to the first end of the boarding pole, as described with reference to FIG. 1.

The attachment devices are located in the deck of the vessel. A first of the attachment devices is located close to the bow. A second of the attachment devices 301 is located further aft in the vessel, forward of the console 206. A third of the attachment devices 301 is located aft of the console 206.

Thereby, the boarding pole can be moved, to be raised selectively at one of three locations in the vessel. This facilitates adapting boarding actions to different situations.

It should be noted that one or more, or all of, the attachment devices 301 may be mounted on a respective rail, which may extend in the longitudinal direction of the vessel, so that the position of each attachment device along the rail may be adjusted.

The vessel further comprises a plurality of, in this example three, air supply connections 333 for the boarding pole 3. The boarding pole is provided with an air conduit, (see #308 in FIG. 1), which is arranged to be connected, at a distal end thereof, to a selective of the air supply connections 333. Each connection is connected by an air conduit 332 with one or more, in this example two, pressurized air sources in the form of gas cylinders 331. The gas cylinders are stored in the console 206.

Each connection 333 is provided in a vicinity of a respective of the attachment devices 301. Thereby, each connection 333 is provided in relation to a respective of the attachment devices 301, so that the boarding pole may be connected to the respective air supply connection 333, while the boarding pole is connected to the respective attachment device 301. Thereby, the conduit on the boarding pole may be relatively short.

More generally than what is depicted in the example in FIG. 6, the following is provided: A marine surface vessel arranged to carry a boarding pole 3 for maritime boarding actions, wherein the vessel comprises a plurality of attachment devices 301 at a deck 205 of the vessel, each of the attachment devices 301 being adapted to be connected to a flexible joint 303 provided at a first end 302 of the boarding pole 3. The attachment devices may be mounted to the deck directly, or via a device, such as a rail. Preferably, the vessel comprises a plurality of air supply connections 333 for the boarding pole 3, each air supply connection being provided in relation to a respective of the attachment devices 301, so that the boarding pole 3 may be connected to the respective air supply connection, while the boarding pole is connected to the respective attachment device. The vessel may be a marine surface vessel 1 comprising a boarding pole 3 for maritime boarding actions, according to any embodiment claimed or described herein.

Figure 7:
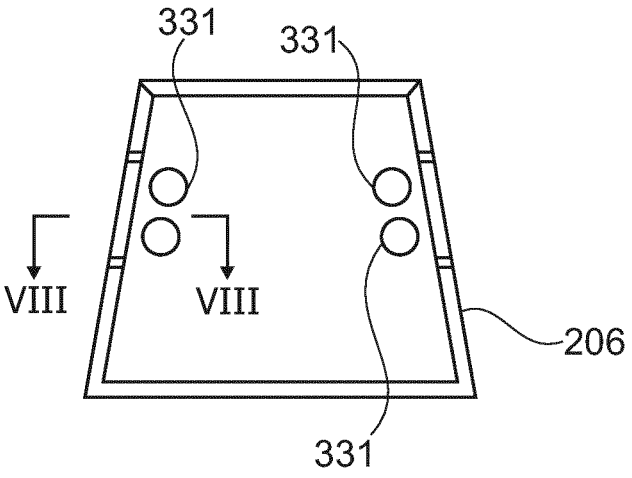
FIG. 7 is shows a horizontal cross-section, seen from above, of a console in the vessel in FIG. 6.
Figure 8:
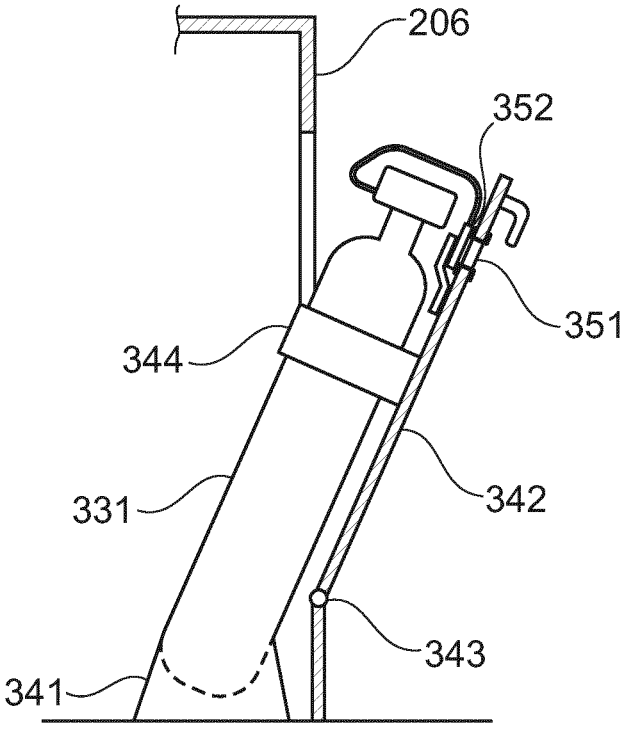
FIG. 8 shows a cross-section, oriented as indicated by the arrows VIII-VIII in FIG. 7.

Reference is made to FIG. 7 and FIG. 8. FIG. 7 shows a horizontal cross-section of the console 206. The console may be the console of any of the vessels described above with reference to FIG. 1-FIG. 6. The console 206 forms a storage compartment for one or more, on this example four, pressurized air sources in the form of elongated gas cylinders 331. The gas cylinders 331 are arranged to provide pressurized air for a boarding pole 3 for maritime boarding actions, as described above. For this, the gas cylinders are connectable to one or more air conduits, (see #332 FIG. 6), connected to one or more air supply connections for the boarding pole.

The storage compartment 206 is arranged to store the gas cylinders 331 substantially vertically. As can be seen in FIG. 8, for each of the gas cylinders 331, a seat 341 is provided. The seat 341 is arranged so as for the gas cylinder 331 to rest with a lower end of the gas cylinder in the seat. For this the seat may present a shape that is complementary to the shape of the lower end of the gas cylinder 331. For example, the seat may present a part spherical concavity.

The storage compartment 206 further comprises a hatch 342 for accessing the gas cylinders 331 from outside of the storage compartment 206. In this example, each hatch allows the access of two of the gas cylinders 331. The hatch 342 is hinged along a lower edge thereof, by means of a hinge 343. The hatch 342 is arranged to open outwards.

A fastening arrangement 344 is arranged to secure, above the seat, the gas cylinders 331 to the hatch 342. The fastening arrangement may comprise one or more straps.

Thereby when the hatch 342 is opened, the gas cylinders follow the hatch, and is tilted outwards, while gas cylinders still rest in the seat 341. Subsequently, the fastening arrangement may be loosened, and the gas cylinder may be removed, to be exchanged.

More generally than what is depicted in FIG. 7 and FIG. 8, the following is provided: A storage compartment 206 for at least one elongated gas cylinder 331 for pressurized air for a boarding pole 3 for maritime boarding actions, the storage compartment being fitted, or arranged to be fitted, in a marine surface vessel 1 arranged to carry the boarding pole, wherein the storage compartment comprises a hatch 342, hinged along an edge thereof, and arranged to open outwards, the storage compartment further comprising a fastening arrangement 344 arranged to secure the gas cylinder to the hatch. The hinge is preferably perpendicular to a longitudinal direction of the gas cylinder. Preferably, the storage compartment is arranged to store the gas cylinder 331 substantially vertically, wherein the storage compartment comprises a seat 341 for the gas cylinder, arranged so as for the gas cylinder to rest with a lower end of the gas cylinder in the seat, the hatch 342 being hinged along a lower edge thereof, the fastening arrangement 344 being arranged to secure, above the seat, the gas cylinder to the hatch. Thereby the hatch may be substantially vertical when closed. However, in some embodiments the hatch may have another orientation, e.g. substantially horizontal, when closed. The storage compartment may be included in a marine surface vessel 1 comprising a boarding pole 3 for maritime boarding actions, according to any embodiment claimed or described herein.

As exemplified in FIG. 8, a pressure gauge 352 may be connected to the gas cylinder 331. The pressure gauge 352 may be connected to the gas cylinder with a rigid connected, or, as depicted in FIG. 8, with a flexible conduit. A window 351 may be provided in the hatch 342. The pressure gauge 352 may be reliably fastened to the hatch 342, e.g. with a clamp. The pressure gauge 352 may be placed so as to be readable through the window 351.

Figure 9:
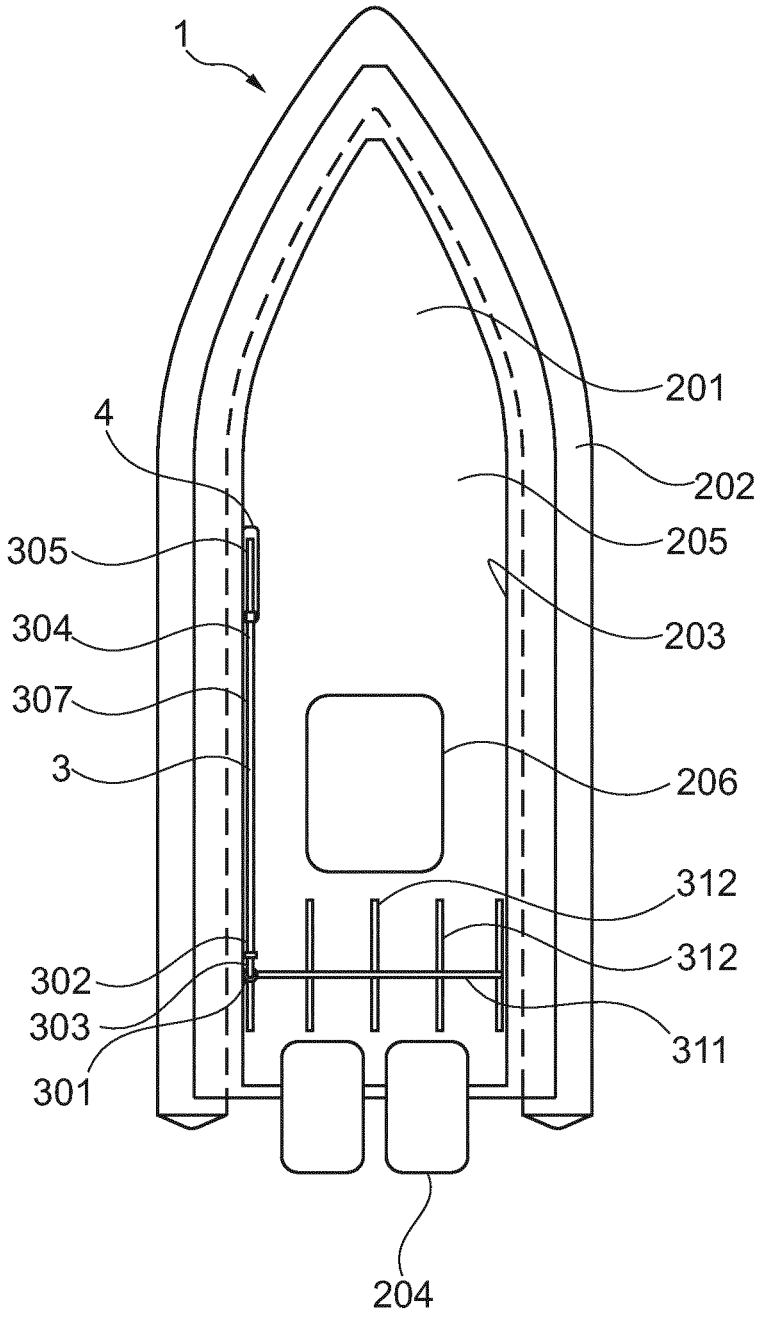
FIG. 9 shows a top view of a vessel according to another embodiment of the invention.

FIG. 9 shows a top view of a marine surface vessel according to another embodiment of the invention. The Vessel is in the form of a rigid-inflatable boat (RIB) 1. The vessel in FIG. 1 comprises a solid hull 201 and an inflatable, flexible tube 202, forming a part of a gunwale 203 of the vessel. It is understood that the gunwale is the top edge of the side of a vessel. The vessel comprises a deck 205. The deck is surrounded by the gunwale 203. The gunwale 203 extends above the level of a deck. At the stern 102, an outboard engine mounting board is provided, with one or more, in this example two, outboard engines 204. The vessel further comprises a steering console 206.

The vessel is arranged to carry a boarding pole 3 for maritime boarding actions. The vessel comprises an attachment device 301 in the deck 205 of the vessel. The attachment device is adapted to be connected to a flexible joint 303 provided at a first end 302 of the boarding pole.

The attachment device 301 is mounted on a first rail 311. The attachment device 301 is arranged to be moved along the first rail 311. The attachment device 301 is arranged to be fixed to the first rail 311 at a plurality of locations along the first rail.

The first rail 311 is mounted a plurality of, in this example five, second rails 312. The second rails 312 are oriented at a non-zero angle, in this example perpendicularly, to the first rail 311. The second rails 312 are mounted to the deck 205 of the vessel.

The first rail 311 is arranged to be moved along the second rails 312. The first rail 311 is arranged to be fixed to the second rails 312 at a respective plurality of locations along the second rails. Thereby, the attachment device 301, and thereby the first end of the boarding pole, may be positioned at a plurality of locations in two dimensions along the deck 205.

In this example, the first and second rails 311, 312 are located aft of the steering column 206. Alternatively, the first and second rails 311, 312 could be located on any suitable area of the deck 205, e.g. forward of the steering column 206.

In FIG. 9, the boarding pole 3 is depicted in a stowed position. Thereby, the first end 302 of the boarding pole 3 is located at a port side of the gunwale 203.

As in the embodiments described above, at a second end 304 of the boarding pole 3, which is opposite to the first end 302, the boarding pole 3 is provided with a boarding engagement device 305. The boarding engagement device is provided in the form of a hook. Between the flexible joint 303 and the boarding engagement device 305, the boarding pole 3 presents an elongated portion 307.

In FIG. 9, the boarding pole 3 is substantially parallel with the longitudinal direction of the vessel. By means of the flexible joint 303, the boarding pole 3 may be erected by a person, while attached to the attachment device 301. The attachment device 301 may be moved by means of the first and second rails 311, 312.

As in the embodiments above, the boarding pole 3 may be telescopic, it may comprise a maneuvering device 306, and it may comprise a conduit 308 for the provision of pressurized air, for extending the boarding pole 3 in a telescopic manner.

Figure 10:
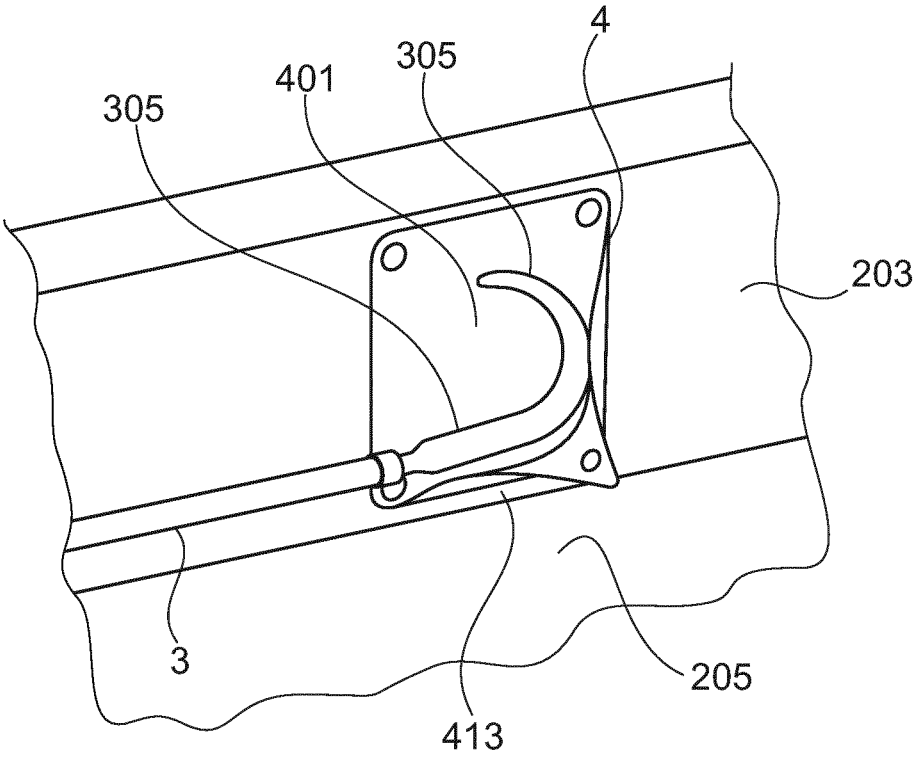
FIG. 10 shows a perspective view of a part of the vessel on FIG. 9, with a holding device.

Reference is made also to FIG. 10. The vessel 1 comprises a holding device 4. In this embodiment, the holding device 4 is flexible. The holding device is made by fabric. The holding device 4 is formed as a pocket. The holding device 4 is mounted to the gunwale 203 of the vessel.

For stowing the boarding pole 3, a flexible side 413 of the holding device 4 is partly released. The engagement device 305 is placed in the holding device 4, and the flexible side 413 is attached to the gunwale 203 to enclose the engagement device 305. Thereby, the holding device 4 is arranged to present a holding cavity 401 for the engagement device. When the engagement device 305 is removed from the holding device, the flexibility allows the holding device to be collapsed by being flattened.

It is to be understood that the present invention is not limited to the embodiments described above and illustrated in the drawings; rather, the skilled person will recognize that many changes and modifications may be made within the scope of the appended claims.

I claim:

1. A marine surface vessel comprising a boarding pole for maritime boarding actions, wherein the boarding pole is, at a first end of the boarding pole, attached to a deck of the marine surface vessel via a flexible joint, wherein the marine surface vessel comprises a holding device presenting, or being arranged to present, a holding cavity, the holding cavity being arranged to receive, in a non-erected condition of the boarding pole, a boarding engagement device at a second end of the boarding pole, which second end is opposite to the first end.

2. A marine surface vessel according to claim 1, wherein the holding device is a holding structure.

3. A marine surface vessel according to claim 1, wherein the holding device is arranged to surround the boarding engagement device on at least three sides of the boarding engagement device.

4. A marine surface vessel according to claim 1, wherein the holding device is arranged to extend, in relation to the marine surface vessel, below the boarding engagement device, and on both lateral sides of the boarding engagement device.

5. A marine surface vessel according to claim 1, wherein the holding cavity has a larger extension vertically and longitudinally, than laterally, in relation to the marine surface vessel.

6. A marine surface vessel according to claim 1, wherein the holding device comprises a cover.

7. A marine surface vessel according to claim 1, wherein the holding device presenting a storage cavity arranged to receive a flexible climbing means attached to the boarding pole.

8. A marine surface vessel according to claim 1, wherein the boarding pole is, while the boarding engagement device is received in the holding cavity, substantially parallel with a longitudinal direction of the marine surface vessel.

9. A marine surface vessel according to claim 1, wherein the holding device is, in the marine surface vessel, located forward of the flexible joint.

10. A marine surface vessel according to claim 1, wherein the holding device is, in the marine surface vessel, located aft of the flexible joint.

11. A marine surface vessel according to claim 1, wherein the holding device is flexible.

12. A marine surface vessel arranged to carry a boarding pole for maritime boarding actions, the marine surface vessel comprises an attachment device at a deck of the marine surface vessel, the attachment device being adapted to be connected to a flexible joint provided at a first end of the boarding pole, wherein the marine surface vessel comprises a holding device presenting, or being arranged to present, a holding cavity, the holding cavity being arranged to receive a boarding engagement device at a second end of the boarding pole, which second end is opposite to the first end, wherein the marine surface vessel comprises a plurality of attachment devices at the deck of the marine surface vessel, each of the attachment devices being adapted to be connected to the flexible joint provided at the first end of the boarding pole, whereby the boarding pole may be erected selectively at one of a plurality of locations on the marine surface vessel; and wherein the marine surface vessel comprises a plurality of air supply connections for the boarding pole, each air supply connection being provided in relation to a respective of the attachment devices, so that the boarding pole may be connected to the respective air supply connection, while the boarding pole is connected to the respective attachment device.

13. A marine surface vessel arranged to carry a boarding pole for maritime boarding actions, the marine surface vessel comprises an attachment device at a deck of the marine surface vessel, the attachment device being adapted to be connected to a flexible joint provided at a first end of the boarding pole, wherein the marine surface vessel comprises a holding device presenting, or being arranged to present, a holding cavity, the holding cavity being arranged to receive a boarding engagement device at a second end of the boarding pole, which second end is opposite to the first end;

wherein the attachment device is mounted to the deck so as to be movable, and fixable at any of a plurality of locations distributed in two dimensions along at least a portion of the deck;

wherein the attachment device is mounted on a first rail, and arranged to be moved along the first rail, and fixed to the first rail at any of a plurality of locations along the first rail, wherein the first rail is mounted on one or more second rails, oriented at a non-zero angle to the first rail, wherein the first rail is arranged to be moved along the one or more second rails, and fixed to the one or more second rails at any of a respective plurality of locations along the one or more second rails.

* * * * *